US006681605B1

(12) United States Patent
Huang

(10) Patent No.: US 6,681,605 B1
(45) Date of Patent: Jan. 27, 2004

(54) TUBULAR DOORKNOB WITH ADJUSTMENT DEVICES FOR FIRMLY MOUNTING THE TUBULAR DOORKNOB IN A DOOR

(75) Inventor: Chao-Ming Huang, Kaohsiung Hsien (TW)

(73) Assignee: Taiwan Fu Hsing Industrial Co., Ltd., Kaohsiung Hsien (TW)

( * ) Notice: Subject to any disclaimer, the term of this patent is extended or adjusted under 35 U.S.C. 154(b) by 0 days.

(21) Appl. No.: 10/434,731

(22) Filed: May 9, 2003

(30) Foreign Application Priority Data

Mar. 12, 2003 (TW) ..... 92203765 U

(51) Int. Cl.[7] ..... E05B 13/10; G05G 5/00

(52) U.S. Cl. ..... 70/224; 292/355; 292/347; 292/DIG. 53; 292/DIG. 60; 292/356; 70/461

(58) Field of Search ..... 292/347, 357, 292/350, 355, 358, 359, DIG. 53, DIG. 54, DIG. 60, DIG. 64, 356; 70/224, 461, 466; 16/412, 414

(56) References Cited

U.S. PATENT DOCUMENTS 485,137 A * 10/1892 Richards ..... 292/355
3,075,797 A * 1/1963 Patriquin et al. ..... 292/336.3
3,718,015 A * 2/1973 Tornoe et al. ..... 70/224
4,739,537 A * 4/1988 Wilke ..... 292/336.3
4,869,083 A * 9/1989 DeMarseilles et al. ..... 70/224
4,930,822 A * 6/1990 Shen ..... 292/357
5,409,278 A * 4/1995 Harcourt ..... 292/357
5,411,303 A * 5/1995 To ..... 292/357
5,566,996 A * 10/1996 Massey et al. ..... 292/357
5,732,578 A * 3/1998 Kang ..... 70/224
5,960,517 A * 10/1999 Sprekeler ..... 292/336.3
6,216,500 B1 * 4/2001 Kang ..... 70/224
6,425,273 B1 * 7/2002 Kim et al. ..... 70/224
2002/0117868 A1 * 8/2002 Bates et al. ..... 292/358

* cited by examiner

*Primary Examiner*—John B. Walsh
(74) *Attorney, Agent, or Firm*—Alan D. Kamrath; Rider Bennett, LLP

(57) ABSTRACT

A tubular doorknob includes an inside bracket, an outside bracket and adjustment devices. The outside bracket has two connecting wings, two outside passages, two outside screw holes and an outside adjustment device. The connecting wings protrude from diametrically opposite sides of the outside bracket. The outside passages are defined through the connecting wings. The outside screw holes are defined through the outside bracket and communicate with the outside passages. The outside adjustment device has two sliding blocks and two adjustment screws. The sliding blocks are slidably mounted in the outside passages. The adjustment screws are screwed into the outside screw holes to push the sliding blocks to abut a surface in a doorknob hole in the door. The inside bracket has a configuration similar the outside adjustment device. The extended adjustment devices firmly hold the tubular doorknob in the doorknob hole.

3 Claims, 8 Drawing Sheets

TUBULAR DOORKNOB WITH ADJUSTMENT DEVICES FOR FIRMLY MOUNTING THE TUBULAR DOORKNOB IN A DOOR

BACKGROUND OF THE INVENTION

1. Field of the Invention

The present invention relates to a tubular doorknob, and more particularly to a tubular doorknob with adjustment devices for firmly mounting the tubular doorknob in a door.

2. Description of Related Art

With reference to FIG. 9, tubular doorknobs are mounted in doors (93) to hold doors (93) shut and unlatch and open doors (93). A conventional tubular doorknob comprises an outside handle assembly (91), an inside handle assembly (92) and a latch assembly (not numbered). The tubular doorknob is mounted in a knob hole (931), a transverse latch hole (not shown) and two knob mounting holes (932) formed in a door (93). The transverse latch hole communicates with the knob hole (931). The two knob mounting holes (932) are formed through the door (93) on diametrically opposite sides of the knob hole (931). The latch assembly is mounted in the transverse latch hole, extends into the knob hole (931), connects the outside handle assembly (91) to the inside handle assembly (92) and partially holds the outside handle assembly (91) and the inside handle assembly (92) in the knob hole (931). Since mounting a tubular doorknob in a door (93) is common knowledge for people skilled in this field, a complete description of mounting the tubular doorknob in a door (93) is not provided.

An outside bracket (911), an inside bracket (921) and fasteners such as bolts (94) are used to align and securely hold the outside handle assembly (91) and the inside handle assembly (92) in the knob hole (931) in a door (93). The outside bracket (911) has a central hole (not numbered), two mounting tubes (912) and an inner flange (not numbered). The flange protrudes from the central hole. Each mounting tube (912) protrudes from the outside bracket (911) toward the inside handle assembly (92), has an internal thread (not numbered) and is mounted in the corresponding knob mounting holes (932) in the door (93).

The inside bracket (921) has a central hole (not numbered), two mounting holes (922) and an inner flange (not numbered). The inner flange is formed around the central hole. The two mounting holes (922) respectively correspond to the mounting tubes (912) extending from the outside bracket (911).

Fasteners, such as bolts (94), attach the inside bracket (921) to the outside bracket (912) on opposites sides of the door (93) around the knob hole (931). Each bolt (94) has a distal end (not numbered), a proximal end (not numbered), an enlarged head (not numbered) and an external thread (not numbered). The enlarged head is formed on the proximal end of the bolt (94), and the external thread is formed around the distal end of the bolt (94). The distal ends of the bolts (94) pass respectively through the mounting holes (922) in the inside bracket (921) and into the knob mounting holes (932) and screw into the mounting tubes (912). Screwing the bolts (94) into the mounting tubes (912) draws the outside bracket (911) and the inside bracket (921) together against the door (93). The tubular doorknob is held axially in place in the door (93) by the flanges on the inside bracket (921) and the outside bracket (911).

However, the conventional tubular doorknob has some shortcomings.

First, the tubular doorknob cannot be held precisely in the knob hole (931) in the door (93). Because the knob hole (931) is always defined with a tolerance so the tubular doorknob can be easily mounted in the knob hole (931), only the flanges on the outside bracket (911) and the inside bracket (921) and the connect ion with the latch assembly hold the tubular doorknob in place radially in the knob hole (931). However, extensive use gradually reduces the ability of the flanges to hold the tubular knob. The tubular doorknob will eventually spin or slip in the knob hole (931). The movement or rotation of the tubular doorknob in the knob hole (931) may keep the tubular doorknob from operating properly.

Second, the conventional tubular doorknob only has two mounting tubes (912) to hold the tubular doorknob axially in the knob hole (931). As the flanges on the inside bracket (921) and the outside bracket (911) deform and the two bolts (94) in the mounting tubes (912) loosen, the tubular doorknob loosens in the door (93). With the tubular doorknob loose, a thief can more easily jimmy the latch assembly and open the locked door (93).

To overcome the shortcomings, the present invention provides an improved tubular doorknob with adjustment devices for firmly mounting the tubular doorknob in a door to mitigate or obviate the aforementioned problems.

SUMMARY OF THF INVENTION

The main objective of the invention is to provide a tubular doorknob with adjustment devices for firmly mounting the tubular doorknob in a door.

To achieve this objective, the tubular doorknob with the adjustment devices for firmly mounting the tubular doorknob in a door has an inside bracket, an outside bracket and adjustment devices. The outside bracket has an inside side, an outside side, two connecting wings, two passages, two screw holes and an adjustment device. The connecting wings protrude from diametrically opposite sides of the inside side of the outside bracket. The passages are respectively defined through the connecting wings and correspond to each other. The screw holes are defined through the outside bracket from the outside side and communicate respectively with the passages. The adjustment device is mounted in the outside-bracket and has two sliding blocks and two adjustment screws. The sliding blocks are slidably mounted in the passages. The adjustment screws are screwed into the screw holes to push the sliding blocks against a surface of a doorknob hole in the door. The inside bracket has a similar configuration. Consequently, the adjustment devices will firmly hold the tubular doorknob in the door.

Other objects, advantages and novel features of the invention will become more apparent from the following detailed description when taken in conjunction with the accompanying drawings.

BRIEF DESCRIPTION OF THF DRAWINGS

Figure 1:
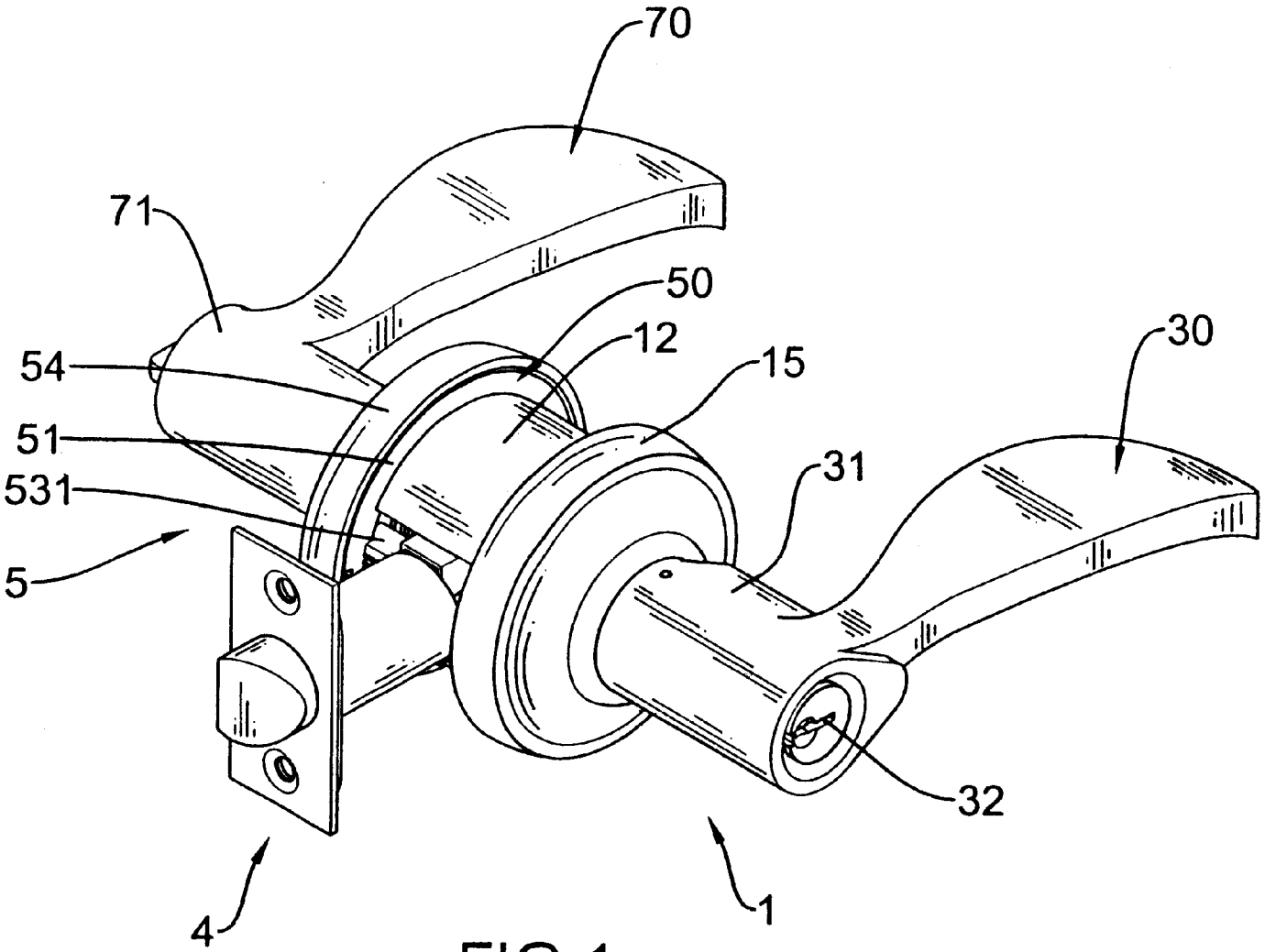
FIG. 1 is an enlarged perspective view of a tubular doorknob with adjustment devices in accordance with the present invention.
Figure 2:
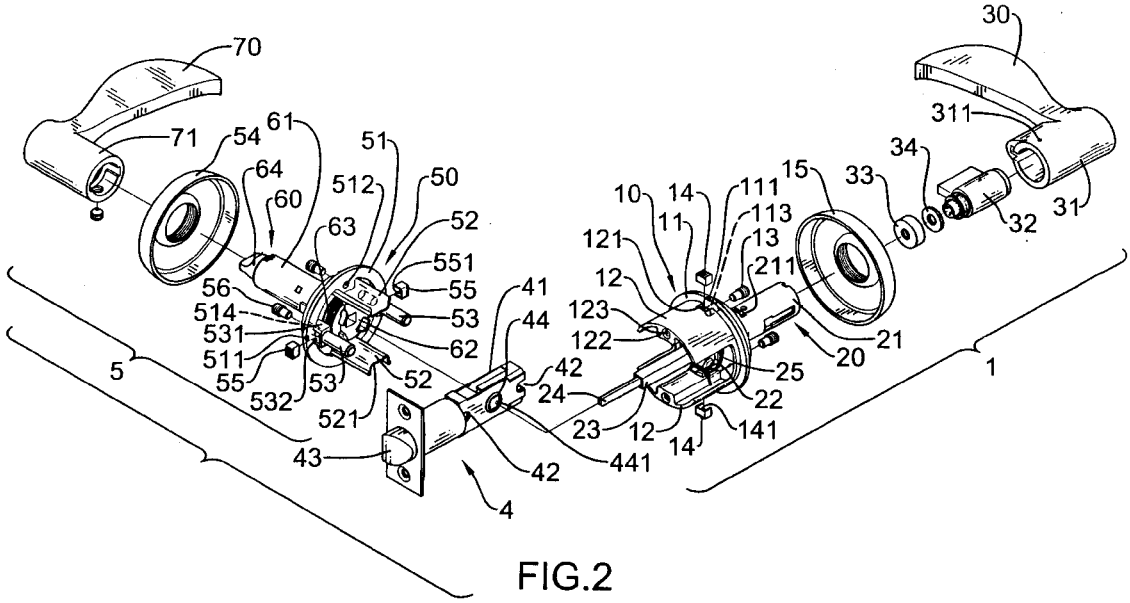
FIG. 2 is an exploded perspective view of the tubular doorknob in FIG. 1.
Figure 4:
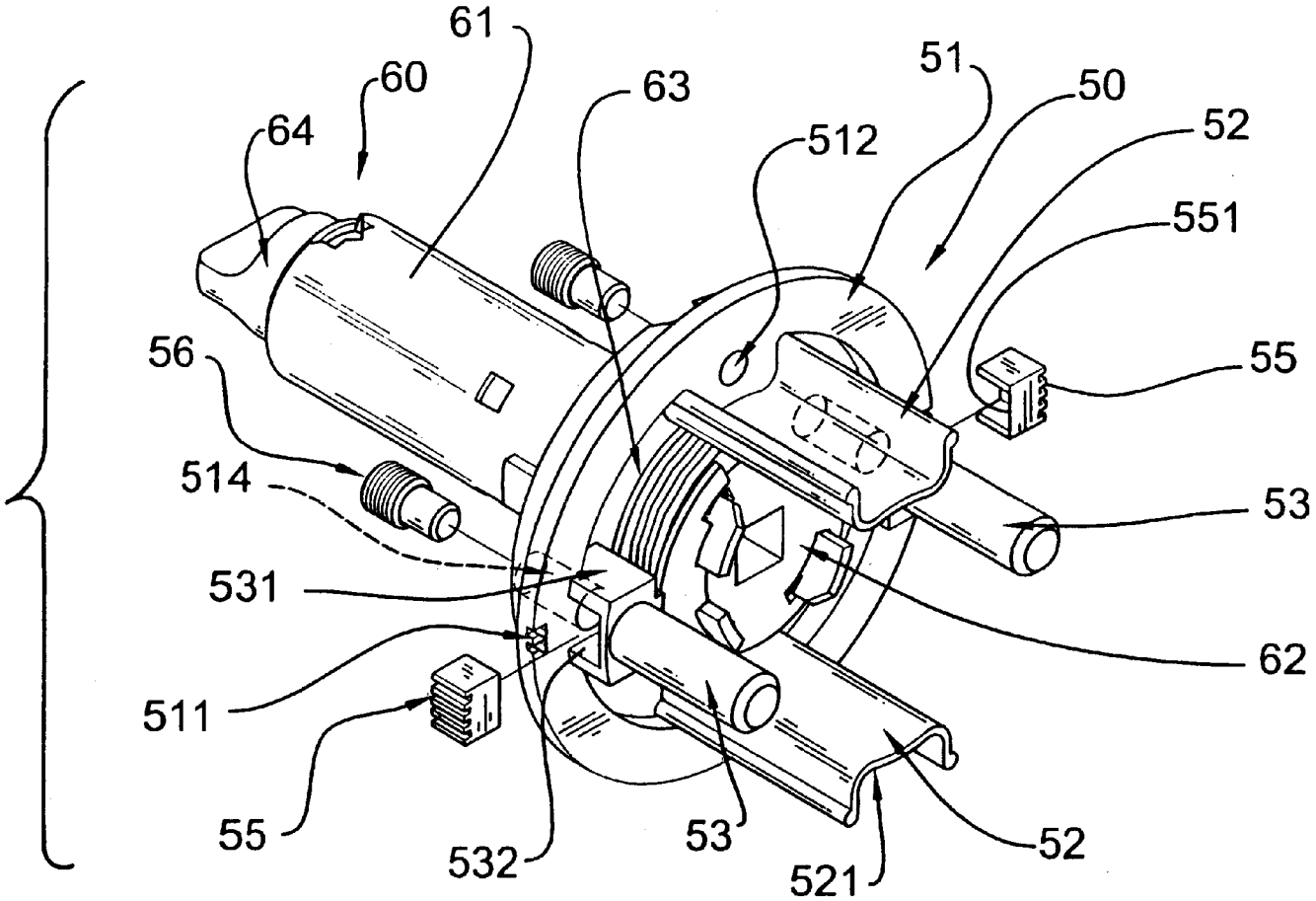
Figure 5:
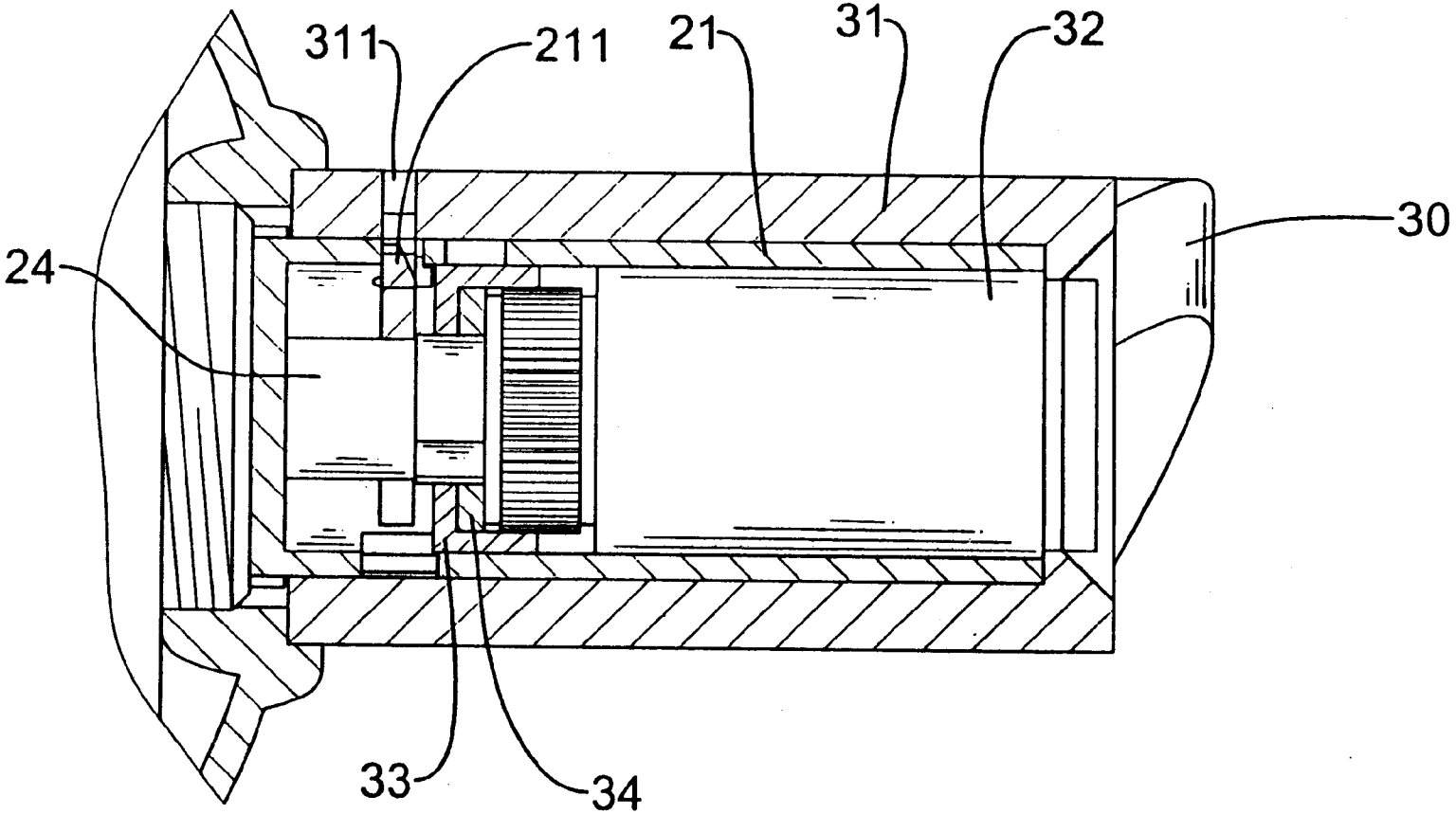
Figure 6:
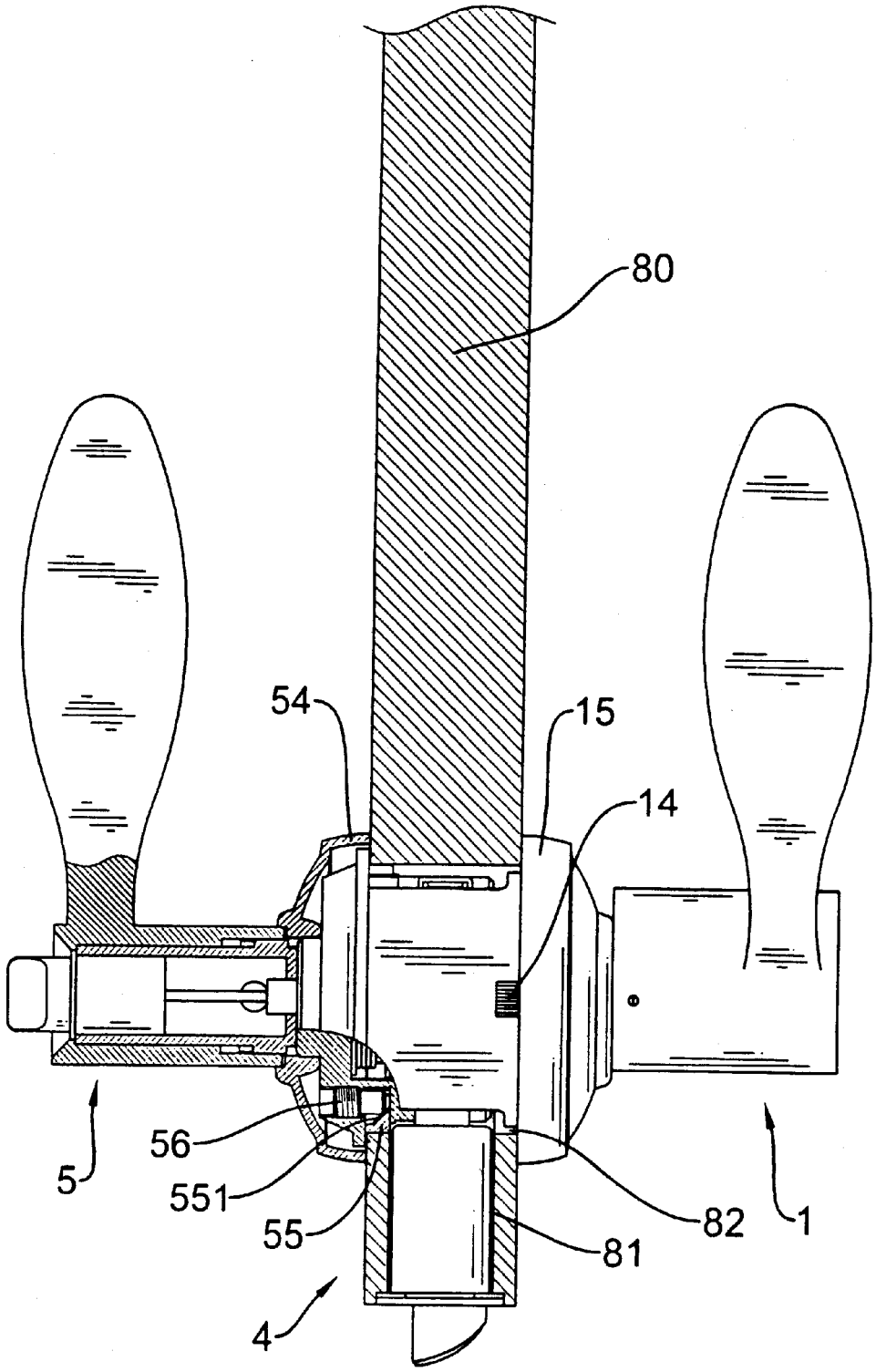
Figure 7:
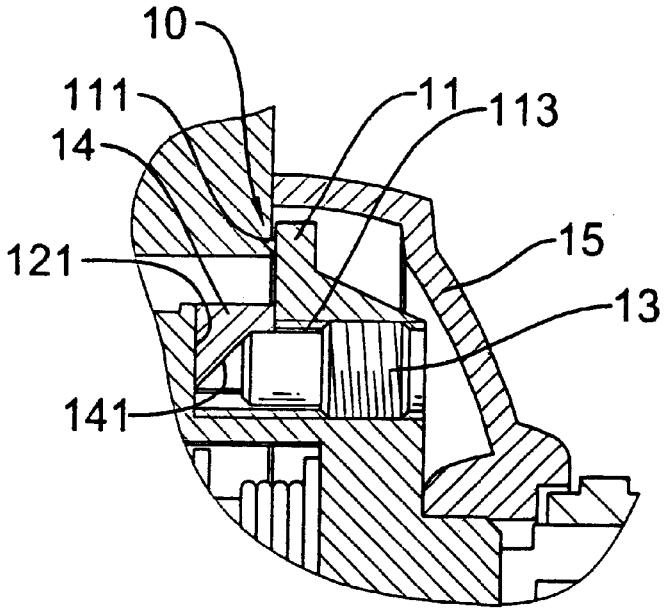
Figure 8:
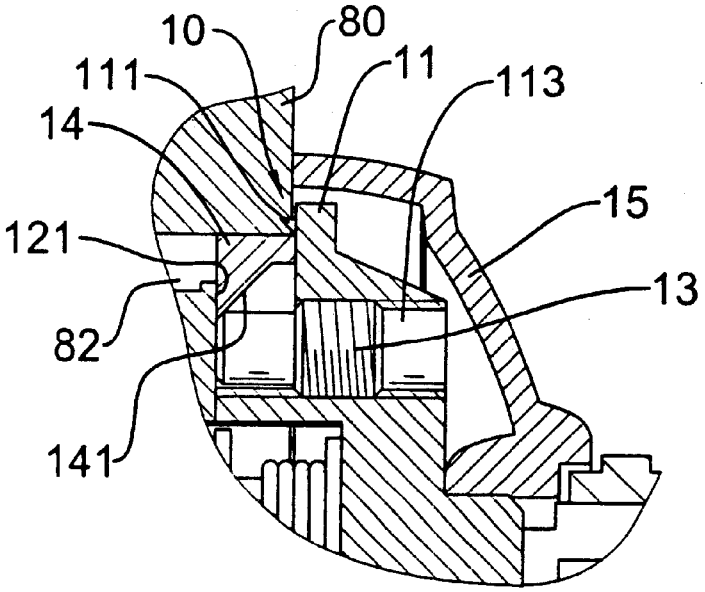
Figure 9:
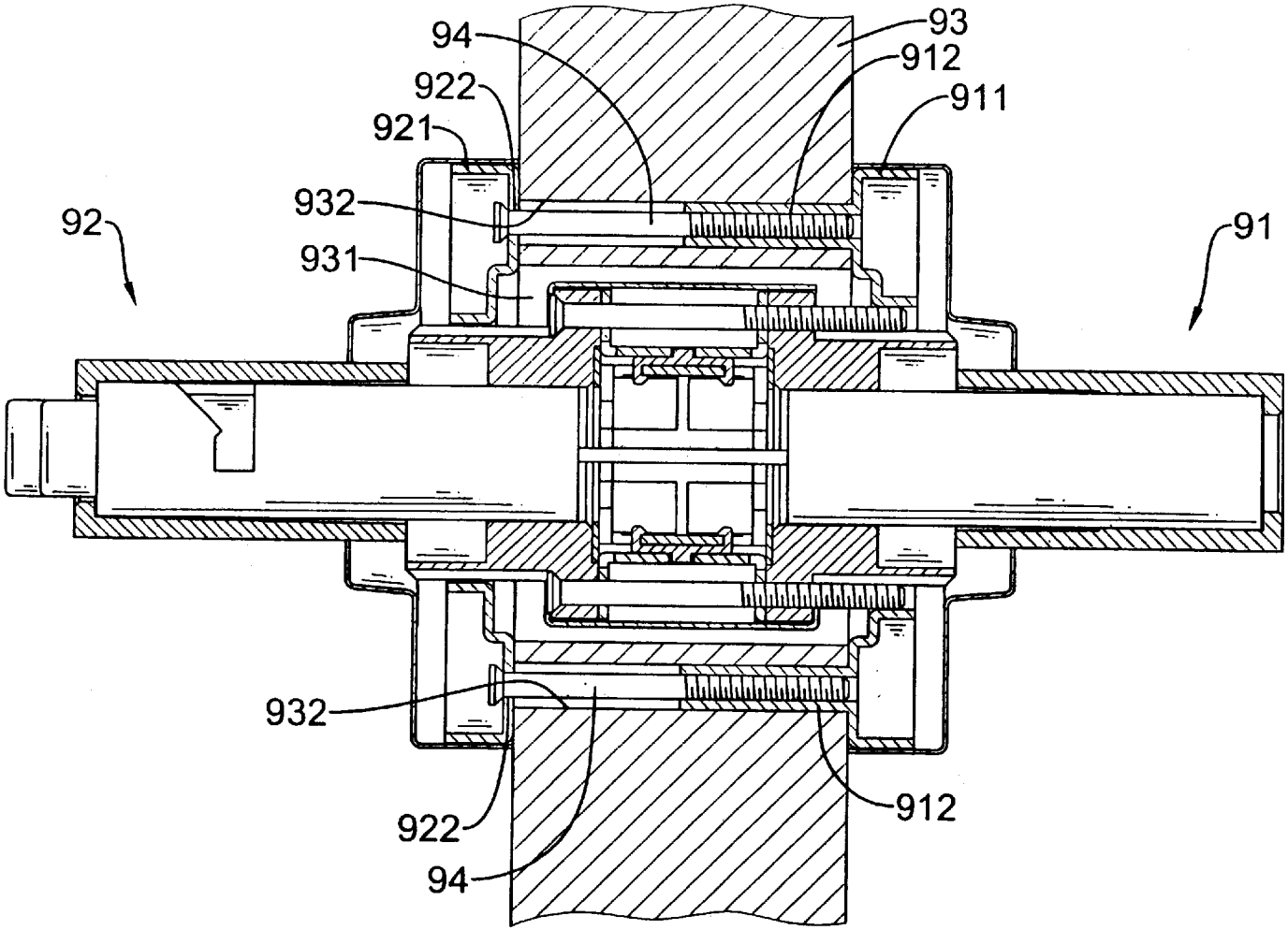
FIG.9 PRIOR ART

FIG. 4 an enlarged perspective view of an inside bracket assembly of the tubular doorknob in FIG. 2;

FIG. 5 is an enlarged side plan view in partial section of the outside handle assembly of the tubular doorknob in FIG. 2 when the tubular doorknob is locked;

FIG. 6 is an enlarged operational top plan view in partial section of the tubular doorknob in FIG. 1 mounted in a door;

FIG. 7 is an enlarged side plan view in partial section of an adjustment device in the tubular doorknob in FIG. 2 when the tubular doorknob is mounted in a door;

FIG. 8 is an enlarged side plan view in partial section of the adjustment device in the tubular doorknob in FIG. 2 when the adjustment device is fully seated; and FIG. 9 is an operational side plan view in partial section of a conventional tubular doorknob in accordance with the prior art.

DETAILED DESCRIPTION OF PREFERRED EMBODIMENT

With reference to FIGS. 1 and 2, a tubular doorknob with adjustment devices in accordance with the present invention comprises an outside handle assembly (1), an inside handle assembly (5), a latch assembly (4), a driving rod (23) and a connecting rod (24). The outside and the inside handle assemblies (1, 5) are connected to each other and the latch assembly (4) by the driving rod (23) and the connecting rod (24).

Figure 3:
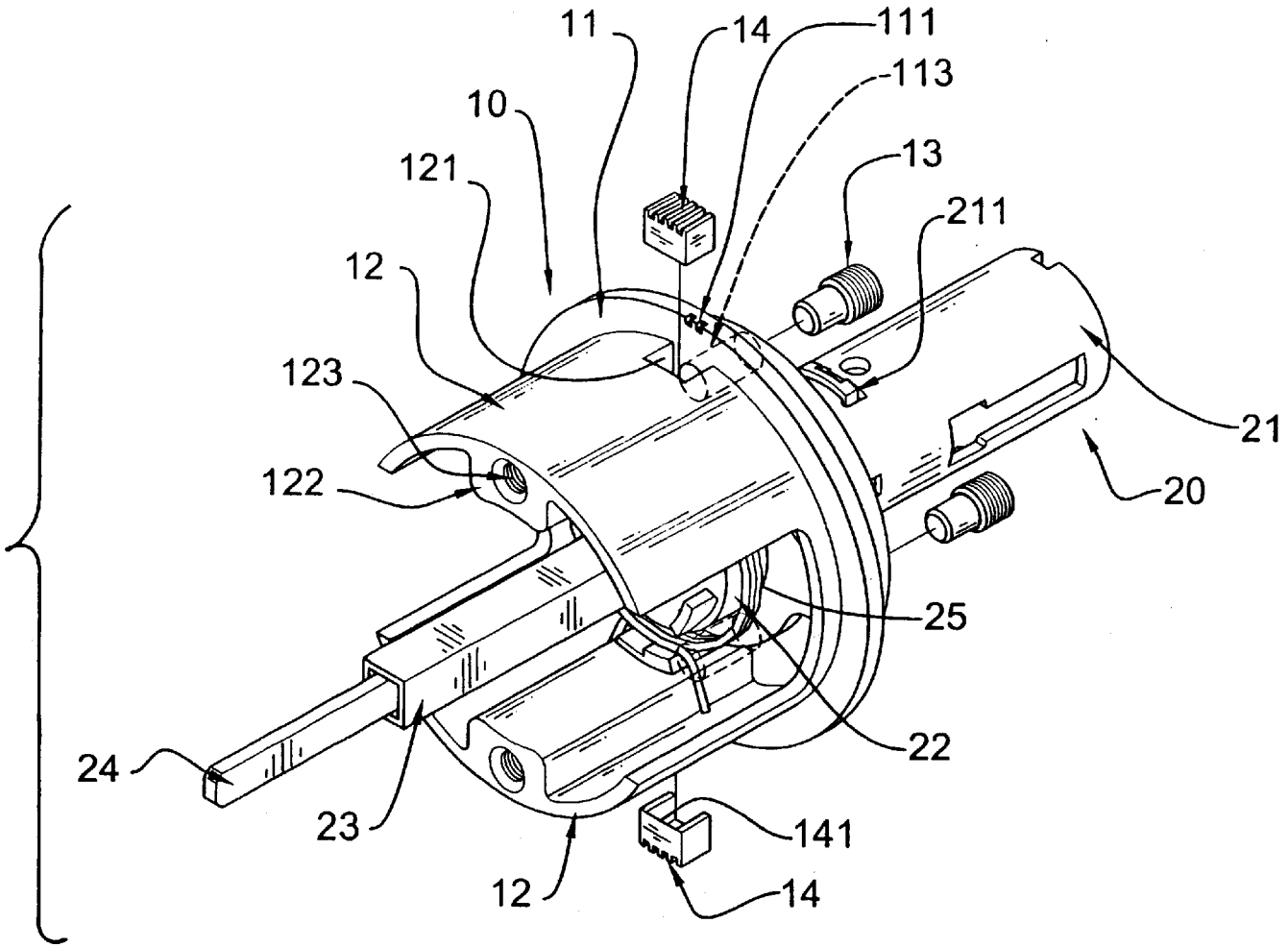
FIG. 3 is an enlarged perspective view of an outside bracket assembly of the tubular doorknob in FIG. 2.

With further reference to FIG. 3, the outside handle assembly (1) comprises an outside bracket assembly (10), an outside rose (15), a lock cylinder (32), an outside handle (30), a positioning sleeve (33) and a washer (34). The outside bracket assembly (10) comprises an outside bracket (11), an outside spindle assembly (20) and an outside adjustment device (not numbered). The outside spindle assembly (20) and the outside adjustment device are mounted in the outside bracket (11).

The outside bracket (11) has a center (not shown), a through hole (not shown), an outside side (not shown), an inside side (not numbered), two connecting wings (12), two outside passages (121) and two outside-screw holes (113). The through hole is axially defined through the center of the outside bracket (11), and the outside spindle assembly (20) is rotatably mounted in the through hole. The connecting wings (12) are formed on and extend perpendicular from diametrically opposite sides of the inside side of the outside bracket (11). Each connecting wing (12) has an outer surface (not numbered), an inner surface (not numbered), and a key (122). The key (122) is formed longitudinally on the inner surface of the connecting wings (12) and has a cross section (not shown) with a shape (not numbered) and a threaded hole (123). The threaded hole (123) is defined longitudinally through the key (122).

The outside passages (121) are radially defined respectively through the outer surfaces of the connecting wings (12) and correspond to the keys (122). The outside screw holes (113) are defined longitudinally through the outside side of the outside bracket (11), correspond to the outside passages (121) and communicate respectively with the outside passages (121).

The outside adjustment device is mounted in the outside bracket (11) and has two sliding blocks (14), two adjustment screws (13) and two stops (111). The sliding blocks (14) are slidably mounted respectively in the outside passages (121). Each sliding block (14) has an inclined surface (141) facing the center of the outside bracket (11). The adjustment screws (13) screw respectively into the outside screw holes (113), and each adjustment screw (13) has a distal end (not numbered) that abuts the inclined surface (141) of the corresponding sliding block (14). To prevent the sliding blocks (14) from sliding completely out of the outside passages (121), the stops (111) are protruded from the inside side of the outside bracket (11) and correspond to the outside passages (121) after the sliding blocks (14) are respectively slidably mounted in the outside passages (121).

The outside spindle assembly (20) comprises an outside spindle (21), an outside support cap (22) and an outside coil spring (25). The outside spindle (21) is hollow, is rotatably mounted in the through hole in the outside bracket (11) with the outside support cap (22) and the outside coil spring (25) and has a latch (211). The outside support cap (22) is attached to the outside spindle (21) and has a central square hole (not shown). The outside coil spring (25) is attached to and mounted around outside support cap (22) to provide a restitution force to the outside spindle (21). The latch (211) is retractably mounted in the outside spindle (21) outside the through hole in the outside bracket (11) and has a top nub (not shown).

With further reference to FIG. 5, the lock cylinder (32) is mounted in the outside spindle (21) and has a coupling end (not numbered) with a rectangular hole (not shown). The outside rose (15) is attached to the outside side of the outside bracket (11). The outside handle (30) is attached to the outside spindle (21) and has a connecting cylinder (31) with a slot (311). The connecting cylinder (31) is mounted around and held on the outside spindle (21), and the top nub of the latch (211) selectively engages the slot (311). Rotation of the connecting rod (24) will push the latch (211) upward to allow the top nub to engage the slot (311), or retract the latch (211) so the top nub disengages from the slot (311). When the top nub engages the slot (311), the outside handle (30) will not rotate relative to the outside spindle (21) such that the outside handle (30) cannot be turned. Optionally, the positioning sleeve (33) and the washer (34) are respectively attached to the coupling end of the lock cylinder (32), where the washer (34) is mounted between the positioning sleeve (33) and the coupling end of the lock cylinder (32). The positioning sleeve (33) will further keep the tubular doorknob from being picked by a thief through the slot (311). Because the positioning sleeve (33) will abut the latch (221), a thief will not easy to pick the tubular lock by pressing the top nub of the latch (211) into the outside of the spindle (21).

With reference to FIGS. 2 and 4, the inside handle assembly (5) has a configuration similar to the outside handle assembly (1). The inside handle assembly (5) comprises an inside bracket assembly (50), an inside rose (54) and an inside handle (70). The inside bracket assembly (50) comprises an inside bracket (51), an inside spindle assembly (60) and an inside adjustment device (not numbered).

The inside bracket (51) has a center (not shown), a through hole (not shown), an outside side (not shown), an inside side (not numbered), two mounting holes (512), two keyway wings (52), two U-shaped brackets (531), two inside screw holes (514) and two positioning stubs (53). The through hole is axially defined through the center of the inside bracket (51), and the inside spindle assembly (60) is rotatably mounted in the through hole in the inside bracket (51). The keyway wings (52) are formed on and extend perpendicular from diametrically opposite sides of the inside side of the inside bracket (51) and correspond to the keys (122) on the outside bracket (11). Each keyway wing (52) has a keyway (521). The keyway (521) is longitudinally formed in the keyway wing (52) and has a cross section with a shape (not numbered) corresponding to the shape of the cross section of the key (122). The mounting holes (512) are defined longitudinally through the outside side of the inside bracket (51) and are aligned respectively with the threaded holes (123) in the outside bracket (11). Bolts (not shown) extend respectively through the mounting holes (512) and screw into the threaded holes (123) to securely attach the inside bracket assembly (50) to the outside bracket assembly (10). The U-shaped brackets (531) are mounted on diametrically opposite sides of the inside side of the inside bracket (51) and form two radial inside passages (532). The two positioning stubs (53) are mounted respectively on U-shaped brackets (531) and extend perpendicular from the inside side of the inside bracket (51). Each positioning stub (53) has a distal end (not numbered) facing the latch assembly (4). The inside screw holes (514) are defined longitudinally through the outside side of the inside bracket (51), correspond to the inside passages (532) and communicate with the inside passages (532), respectively.

The inside adjustment device is mounted in the inside bracket (51) and has two sliding blocks (55), two adjustment screws (56) and two stops (511). The sliding blocks (55) are slidably mounted respectively in the inside passages (532). Each sliding block (55) has an inclined surface (551) facing the center of the inside bracket (51). The adjustment screws (56) screw respectively into the corresponding inside screw holes (514). Each adjustment screw (56) has a distal end (not numbered) that abuts the inclined surface (551) of the corresponding sliding blocks (55) and forces the corresponding sliding block (55) to move radially outward as the adjustment screw (56) is screwed into the screw hole (514). To prevent the sliding blocks (55) from sliding out of the inside passages (532), the stops (511) protrude from the inside side of the inside bracket (51) and correspond to the inside passages (532) after the sliding blocks (55) are respectively slidably mounted in the inside passages (532).

The inside spindle assembly (60) is rotatably mounted in the through hole in the inside bracket (51) and comprises an inside spindle (61), an inside support cap (62), an inside coil spring (63) and a lock knob (64). The inside spindle (61) is hollow, is rotatably mounted in the through hole in the inside bracket (51) with the inside support cap (62) and the inside coil spring (63). The inside support cap (62) is attached to the inside spindle (61) and has a central square hole (not numbered). The inside coil spring (63) is attached to and mounted around the inside support cap (62) to provide a restitution force to the inside spindle (61). The inside spindle (61) has an outside open end (not numbered). The lock knob (64) is rotatably mounted in the outside open end of the inside spindle (61).

The latch assembly (4) is conventional, is mounted between the inside and the outside handle assemblies (5, 1) and comprises a body (41), two mounting holes (42), a latch bolt (43) and a driving device (44). The mounting holes (42) are defined transversally through the body (41) and correspond to the positioning stubs (53) in the inside bracket (51). The driving device (44) has a square hole (441) and is mounted in the body (41). The square hole (441) is defined transversally through the body (41) between the two mounting holes (42) to hold the driving rod (23). The latch bolt (43) is retractably attached to the body (41) and is driven by the driving device (44).

The inside rose (54) is attached to the outside side of the inside bracket (51). The inside handle (70) is attached to the inside spindle (61) and has an inside connecting cylinder (71). The inside handle (70) can also be implemented with a knob (not shown). The inside connecting cylinder (71) has a though hole (not numbered). The inside spindle (61) is held in the through hole of the inside connecting cylinder (71), and the lock knob (64) extends out of the through hole in the inside cylinder (71).

With reference to FIGS. 2 and 6, the driving rod (23) has a distal end (not shown) and a proximal end (not numbered), is hollow and square and is mounted through the square hole (441) in the driving device (44) in the latch assembly (4). The distal end of the driving rod (23) passes through and is held in the central square hole in the outside support cap (22). The proximal end of the driving rod (23) is held in the central square hole in the inside support cap (62). Therefore, both the inside and the outside spindles (61, 21) will rotate the driving rod (23) either the inside handle (70) or the outside handle (30) is turned. Rotation of the driving rod (23) causes the driving device (44) to retract the latch bolt (43) into the body (41) to unlatch the door (80).

The connecting rod (24) is rotatably mounted in the hollow driving rod (23) and has a rectangular cross section, a proximal end (not numbered) and a distal end (not shown). The distal end of the connecting rod (24) passes through and protrudes out of the driving rod (23) to couple to coupling end of the lock cylinder (32) and is held in the rectangular hole in the lock cylinder (32). The proximal end of the connecting rod (24) passes through and protrudes out of the driving rod (23) to couple to the lock knob (64). Therefore, either the lock cylinder (32) or the lock knob (64) will rotate the connecting rod (23) that pushes the latch (211) radially outward or allows the latch (211) to move radially inward. When the latch (211) moves radially outward, the top nub engages the slot (211), the outside handle (30) will not turn, and the tubular doorknob is locked.

Mounting the tubular doorknob in a door (80) is quite simple. The door (80) has an inside side (not numbered), an outside side (not numbered), a distal edge (not numbered), a doorknob hole (82) and a latch hole (81). The doorknob hole (82) is formed through the door (80) from the inside side to the outside side and has an inside surface (not numbered). The latch hole (81) is formed in the distal edge of the door (80) and communicates with the doorknob hole (82). The latch assembly (4), inside handle assembly (5) and outside handle assembly (1) are sequentially mounted in holes (81, 82) in the door (80), adjusted and tightened. The latch assembly (4) is mounted in the latch hole (81) with the latch bolt (43) extending out of the latch hole (81).

The inside handle assembly (5) is mounted in the door (80) by inserting the keyway wings (52) and the positioning stubs (53) into the doorknob hole (82) through the inside side of the door (80). The distal ends of the positioning stubs (53) are passed respectively through the mounting holes (42) in the body (41) of the latch assembly (4) to securely hold the latch assembly (4) in place. The inside handle assembly (5) is held in place while the outside handle assembly (1) is installed. The outside handle assembly (1) is mounted in the door (80) by passing the connecting rod (24) and the driving rod (23) through the square hole (441) in the latch assembly (4) and into the central square hole in the inside bracket (51) in the inside handle assembly (5). Simultaneously, the connecting wings (12) are inserted into the doorknob hole (82) so that the keys (122) align respectively with and are inserted into the keyways (521) in the keyway wings (52) on the inside handle assembly (50). To hold the inside handle assembly (5) and the outside handle assembly (1) in the doorknob hole (82), bolts are passed respectively through the mounting holes (512) in the inside bracket assembly (50) and screwed into the threaded holes (123) in the outside bracket assembly (10).

With reference to FIGS. 7 and 8, the doorknob hole (82) is always large to easily accommodate the connecting wings (12) on the outside bracket assembly (10) and the keyway wings (52) and positioning stubs (53) on the inside bracket assembly (50) so the tubular doorknob can be mounted conveniently in the door (80). To securely position and hold the inside handle assembly (5) and the outside handle assembly (1) in the doorknob hole (82), the adjustment screws (13, 56) are screwed into the screw holes (113, 514). The distal ends of the adjustment screws (13, 56) press against the inclined surfaces (141, 551) of the sliding blocks (14, 55) and cause the sliding blocks (14) to move radially outward in the passages (121, 532) and press against the inside surface of the doorknob hole (82). Consequently, the four sliding blocks (14, 55) pressing against the inside surface of the doorknob hole (82) firmly hold the tubular doorknob in the doorknob hole (82).

Installation of the tubular doorknob is completed by pressing the roses (15, 54) respectively onto the outside sides of the outside and inside brackets (11, 51) and the outside and inside handles (30, 70) respectively onto the outside and inside spindles (21, 61).Since the tubular doorknob is held in position in the door (80) by the two keyways (521) combined with the two keys (122), bolts connecting the inside and outside bracket assemblies (50, 10) that clamp the door (80) and the inside and outside adjustment devices, the tubular doorknob will not loosen easily even after extensive use. Consequently, thieves cannot easily jimmy the tubular lock.

Even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

What is claimed is:

1. A tubular doorknob with adjustment devices for firmly mounting the tubular doorknob in a door and the tubular doorknob comprising:

an outside handle assembly comprising an outside bracket with an inside side and an outside side and the outside bracket having a center;

a through hole axially defined through the center of the outside bracket;

two connecting wings formed on and extending perpendicular from diametrically opposite sides of the inside side of the outside bracket, each connecting wing having an inner surface, an outer surface and a key longitudinally formed on the inner surface, the key having a cross section with a shape and a threaded hole longitudinally defined through the key;

two outside passages radially defined respectively through the outer surfaces of the connecting wings on diametrically opposite sides and corresponding to the keys; and two outside screw holes defined longitudinally through the outside side of the outside bracket and respectively communicating with the outside passages;

an outside spindle assembly rotatably mounted in the through hole of the outside bracket and having a hollow outside spindle rotatably mounted in the through hole in the outside bracket;

a lock cylinder with a coupling end mounted in the outside spindle;

a latch retractably attached to the outside spindle;

an outside support cap attached to the outside spindle; and an outside coil spring attached to and mounted around the outside support cap to provide a restitution force to the outside spindle;

an outside adjustment device mounted in the outside bracket and having a sliding block with an inclined surface slidably mounted in each outside passage in the outside bracket; and an adjustment screw screwing into each of the outside screw holes in the outside bracket and having a distal end to abut the inclined surface of a corresponding one of the sliding blocks of the outside adjustment device;

an outside rose attached to the outside side of the outside bracket; and an outside handle attached to the outside spindle and having a slot corresponding to the latch, and the slot selectively engaged by the latch;

an inside handle assembly coupled to the outside handle assembly and comprising an inside bracket with an inside side and an outside side and the inside bracket having a center;

a through hole axially defined through the center of the inside bracket;

two keyway wings formed on and extending perpendicular from diametrically opposite sides of the inside side of the inside bracket, each keyway wing having a keyway corresponding to one of the keys on the connecting wings of the outside bracket and having a cross section with a shape corresponding to the shape of the cross section of the key;

two U-shaped brackets formed on and extending perpendicular from diametrically opposite sides of the inside side of the inside bracket, each U-shaped bracket forming an inside passage;

two positioning stubs formed respectively on and extending perpendicular from the U-shaped brackets;

two inside screw holes defined through the outside side of the inside bracket and respectively communicating with the inside passages; and two mounting holes respectively defined through the outside side of the inside bracket and aligned with the threaded holes of the keys in the outside bracket;

an inside spindle assembly rotatably mounted in the through hole in the inside bracket and having a hollow inside spindle rotatably mounted in the through hole in the inside bracket and having an outside open end;

an inside support cap attached to the inside spindle;

an inside coil spring attached to and mounted around the inside support cap to provide a restitution force to the inside spindle; and a lock knob rotatably mounted in the outside open end of the inside spindle;

an inside adjustment device mounted in the inside bracket and having a sliding block with an inclined surface slidably mounted in each inside passage; and an adjustment screw screwing into each of the inside screw holes and having a distal end to press against the inclined surface of a corresponding one of the sliding blocks of the inside adjustment device;

an inside rose attached to the outside side of the inside bracket; and an inside handle attached to the inside spindle;

a latch assembly mounted between the inside and the outside handle assemblies and comprising a body mounted between the inside and the outside handle assemblies;

two mounting holes transversely defined through the body and corresponding to the positioning stubs on the inside bracket, where the positioning stubs are respectively held in the mounting holes of the body of the latch assembly;

a driving device mounted in the body and having a square hole; and a latch bolt retractably mounted in the body and coupled to the driving device of the latch assembly;

a hollow driving rod mounted between the outside and the inside support caps and having a distal end and a proximal end, the distal end of the driving rod attached to outside support cap, and the proximal end of the driving rod passing through, held in and extending out of the square hole of the driving device to couple to the inside support cap; and a connecting rod rotatably mounted in the driving rod and having a distal end and a proximal end, the distal end and the proximal end of the connecting rod respectively extending out of the driving rod, the distal end of the connecting rod attached to the coupling end of the lock cylinder and the proximal end of the connecting rod attached to the lock knob.

2. The tubular doorknob as claimed in claim 1, wherein stops protrude respectively from the inside side of each of the outside bracket and the inside bracket and correspond respectively to the outside passages and the inside passages.

3. The tubular doorknob as claimed in claim 2, wherein the outside spindle assembly further has a positioning sleeve attached to the coupling end of the lock cylinder; and a washer mounted between the coupling end of the lock cylinder and the positioning sleeve.

* * * * *